US008310417B2

(12) United States Patent
Choi

(10) Patent No.: US 8,310,417 B2
(45) Date of Patent: Nov. 13, 2012

(54) PIXEL AND ORGANIC LIGHT EMITTING DISPLAY USING THE SAME

(75) Inventor: Sang-Moo Choi, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 865 days.

(21) Appl. No.: 12/343,203

(22) Filed: Dec. 23, 2008

(65) Prior Publication Data

US 2009/0225012 A1 Sep. 10, 2009

(30) Foreign Application Priority Data

Mar. 10, 2008 (KR) ..... 10-2008-0021973

(51) Int. Cl.
*G09G 3/30* (2006.01)

(52) U.S. Cl. ..... 345/80

(58) Field of Classification Search ..... None
See application file for complete search history.

(56) References Cited

U.S. PATENT DOCUMENTS

| | | | | |
|---|---|---|---|---|
| 7,545,351 | B2 * | 6/2009 | Shin | 345/82 |
| 2003/0227262 | A1 * | 12/2003 | Kwon | 315/169.3 |
| 2005/0057182 | A1 | 3/2005 | Shibusawa | |
| 2005/0269958 | A1 | 12/2005 | Choi et al. | |
| 2006/0012549 | A1 | 1/2006 | Ikeda | |
| 2006/0253755 | A1 | 11/2006 | Wu | |
| 2008/0055205 | A1 * | 3/2008 | Chung et al. | 345/76 |
| 2008/0055299 | A1 * | 3/2008 | Choi et al. | 345/211 |
| 2008/0111839 | A1 * | 5/2008 | Park | 345/690 |
| 2008/0143651 | A1 * | 6/2008 | Choi et al. | 345/76 |
| 2008/0143704 | A1 * | 6/2008 | Choi | 345/212 |
| 2008/0158114 | A1 * | 7/2008 | Kim | 345/77 |
| 2008/0204384 | A1 * | 8/2008 | Lee et al. | 345/83 |
| 2008/0204397 | A1 * | 8/2008 | Jang et al. | 345/102 |
| 2008/0218448 | A1 * | 9/2008 | Park et al. | 345/76 |

(Continued)

FOREIGN PATENT DOCUMENTS

CN 1722209 A 1/2006

(Continued)

OTHER PUBLICATIONS

KIPO Office Action dated Jul. 29, 2009 for Korean Priority Application 10-2008-0021973.

(Continued)

*Primary Examiner* — Joseph Feild
*Assistant Examiner* — Henok Heyi
(74) *Attorney, Agent, or Firm* — Christie, Parker & Hale, LLP

(57) ABSTRACT

A pixel capable of compensating for the deterioration of an organic light emitting diode. The pixel includes an organic light emitting diode; a second transistor to control a capacity of an electric current that is supplied from a first power source to the organic light emitting diode; a first transistor coupled between a data line and a gate electrode of the second transistor and for turning on when a scan signal is supplied to a scan line; a first capacitor coupled between a power line (that receives a power signal overlapping with the scan signal and having a wider interval (or width) than that of the scan signal) and the gate electrode of the second transistor; and a feedback capacitor coupled between the gate electrode of the second transistor and an anode electrode of the organic light emitting diode.

13 Claims, 4 Drawing Sheets

U.S. PATENT DOCUMENTS

| | | | | |
|---|---|---|---|---|
| 2008/0224965 | A1* | 9/2008 | Kim | 345/76 |
| 2010/0188384 | A1 | 7/2010 | Uchino et al. | |

FOREIGN PATENT DOCUMENTS

| | | | |
|---|---|---|---|
| CN | 101136170 | A | 3/2008 |
| EP | 1 860 637 | A2 | 11/2007 |
| EP | 1 895 498 | A2 | 3/2008 |
| JP | 2005-164891 | | 6/2005 |
| JP | 2005-189673 | | 7/2005 |
| JP | 2006-053539 | | 2/2006 |
| JP | 2007-11218 | | 1/2007 |
| JP | 2007-264464 | | 10/2007 |
| KR | 2003-0081919 | | 10/2003 |
| KR | 10-2005-0073950 | | 7/2005 |
| KR | 2005-0098485 | | 10/2005 |
| KR | 10-2007-0012979 | | 1/2007 |
| KR | 10-0805597 | | 2/2008 |

OTHER PUBLICATIONS

SIPO Patent Gazette dated on Jun. 29, 2011, corresponding to Chinese Patent application 200910004471.9, 3 pages.

Japanese Office Action dated Jun. 14, 2011, corresponding to Japanese Patent application 2008-249910, 2 pages.

Patent Gazette of corresponding European Patent application 09154277.9 dated Oct. 26, 2011.

* cited by examiner

PIXEL AND ORGANIC LIGHT EMITTING DISPLAY USING THE SAME

CROSS-REFERENCE TO RELATED APPLICATIONS

This application claims priority to and the benefit of Korean Patent Application No. 10-2008-0021973, filed on Mar. 10, 2008, in the Korean Intellectual Property Office, the entire content of which is incorporated herein by reference.

BACKGROUND OF THE INVENTION

1. Field of the Invention

The present invention relates to a pixel and an organic light emitting display using the same, and more particularly to a pixel capable of compensating for the deterioration of an organic light emitting diode, and an organic light emitting display using the same.

2. Description of Related Art

In recent years, there have been many attempts to develop various flat panel displays having a lighter weight and a smaller volume than that of a cathode ray tube display. The flat panel displays include a liquid crystal display (LCD), a field emission display (FED), a plasma display panel (PDP), an organic light emitting display (OLED), etc.

Amongst the flat panel displays, the organic light emitting display displays an image by using an organic light emitting diode which generates light by utilizing the recombination of electrons and holes. Such an organic light emitting display has an advantage that it has a rapid response time and may be driven with low power consumption.

FIG. 1 is a circuit diagram schematically showing a pixel 4 of a conventional organic light emitting display.

Referring to FIG. 1, the pixel 4 of the conventional organic light emitting display includes an organic light emitting diode (OLED) and a pixel circuit 2 coupled to a data line (Dm) and a scan line (Sn) to control the organic light emitting diode (OLED).

An anode electrode of the organic light emitting diode (OLED) is coupled to the pixel circuit 2, and a cathode electrode thereof is coupled to the second power source (ELVSS). Such an organic light emitting diode (OLED) generates light with set (or predetermined) luminance to correspond to an electric current supplied from the pixel circuit 2.

The pixel circuit 2 controls an electric current capacity supplied to the organic light emitting diode (OLED) to correspond to a data signal supplied to the data line (Dm) when a scan signal is supplied to the scan line (Sn). For this purpose, the pixel circuit 2 includes a second transistor (M2) coupled between the first power source (ELVDD) and the organic light emitting diode (OLED); a first transistor (M1) coupled between the second transistor (M2), and the data line (Dm) and the scan line (Sn); and a storage capacitor (Cst) coupled between a gate electrode of the second transistor (M2) and a first electrode of the second transistor (M2).

A gate electrode of the first transistor (M1) is coupled to the scan line (Sn), and a first electrode of the first transistor (M1) is coupled to the data line (Dm). A second electrode of the first transistor (M1) is coupled to one side terminal of the storage capacitor (Cst). Here, the first electrode of the first transistor (M1) is set to be a source electrode or a drain electrode, and the second electrode is set to be the other electrode that is different from the first electrode. For example, when the first electrode is set to be a source electrode, the second electrode is set to be a drain electrode. The first transistor (M1), coupled to the scan line (Sn) and the data line (Dm), is turned on when a scan signal is supplied to the scan line (Sn), thereby supplying a data signal, supplied from the data line (Dm), to the storage capacitor (Cst). At this time, the storage capacitor (Cst) is charged with a voltage corresponding to the data signal.

The gate electrode of the second transistor (M2) is coupled to one side terminal of the storage capacitor (Cst), and the first electrode of the second transistor (M2) is coupled to the other side terminal of the storage capacitor (Cst) and the first power source (ELVDD). A second electrode of the second transistor (M2) is coupled to an anode electrode of the organic light emitting diode (OLED). Such a second transistor (M2) controls a capacity of an electric current to correspond to the voltage value stored in the storage capacitor (Cst), the electric current flowing from the first power source (ELVDD) to the second power source (ELVSS) via the organic light emitting diode (OLED). At this time, the organic light emitting diode (OLED) generates light corresponding to the electric current capacity supplied from the second transistor (M2).

However, the above-mentioned organic light emitting display has a problem in that it is difficult to display an image with desired luminance due to the changes in efficiency caused by the deterioration (or degradation) of the organic light emitting diode (OLED). That is, the organic light emitting diode (OLED) deteriorates with time, and therefore it is difficult to display the image with the desired luminance over time because an organic light emitting diode (OLED) that has deteriorated more generates light with lower luminance than that of an organic light emitting diode (OLED) that has deteriorated less.

SUMMARY OF THE INVENTION

An aspect of an embodiment of the present invention is directed toward a pixel capable of compensating for the deterioration of an organic light emitting diode.

Another aspect of an embodiment of the present invention is directed toward an organic light emitting display using the pixel.

An embodiment of the present invention provides a pixel including an organic light emitting diode; a second transistor for controlling a capacity of an electric current that is supplied from a first power source to the organic light emitting diode; a first transistor coupled between a data line and a gate electrode of the second transistor and for turning on when a scan signal is supplied to a scan line; a first capacitor coupled between a power line for receiving a power signal and the gate electrode of the second transistor, the power signal overlapping with the scan signal and having a wider interval than that of the scan signal; and a feedback capacitor coupled between the gate electrode of the second transistor and an anode electrode of the organic light emitting diode.

The pixel according to one embodiment of the present invention further includes a second capacitor coupled between the first power source and the gate electrode of the second transistor.

Another embodiment of the present invention provides a pixel including an organic light emitting diode; a second transistor for controlling a capacity of an electric current supplied from a first power source to the organic light emitting diode; a first transistor coupled between a data line and a gate electrode of the second transistor and for turning on when a scan signal is supplied to a scan line; a first capacitor coupled between the scan line and the gate electrode of the second transistor; a second capacitor coupled between the first power source and the gate electrode of the second transistor; and a feedback capacitor coupled between the gate electrode of the second transistor and an anode electrode of the organic light emitting diode.

Another embodiment of the present invention provides an organic light emitting display including a scan driver for sequentially supplying a scan signal to scan lines; a power signal supply unit for sequentially supplying a power signal to power lines; a data driver for supplying a data signal to data lines to synchronize with the scan signal; and pixels at crossing regions of the scan lines, the data lines and the power lines. Each of the pixels extended in an $i^{th}$ (i is an integer) horizontal line of the organic light emitting display includes an organic light emitting diode; a second transistor for controlling a capacity of an electric current that is supplied from a first power source to the organic light emitting diode; a first transistor coupled between a corresponding data line of the data lines and a gate electrode of the second transistor and for turning on when the scan signal is supplied to an $i^{th}$ scan line of the scan lines; a first capacitor coupled between an $i^{th}$ power line of the power lines and the gate electrode of the second transistor; and a feedback capacitor coupled between the gate electrode of the second transistor and an anode electrode of the organic light emitting diode.

In one embodiment, a voltage of a third power source may be supplied to the $i^{th}$ power line when the power signal is supplied to the $i^{th}$ power line, and a voltage of a fourth power source that is higher than that of the third power source may be supplied to the $i^{th}$ power line when the power signal is not supplied to the $i^{th}$ power line. Also, in one embodiment, the power signal supply unit is adapted to supply the power signal to overlap with the scan signal supplied to the $i^{th}$ scan line, and to supply the power signal to the $i^{th}$ power line, the power signal having a wider interval than that of the scan signal. And, the data signal may be set to a voltage corresponding to a higher grey level than grey levels to be actually expressed.

Another embodiment of the present invention provides an organic light emitting display including a scan driver for sequentially supplying a scan signal to scan lines; a data driver for supplying a data signal to data lines to synchronize with the scan signal; and pixels disposed at crossing regions of the scan lines and the data lines. Each of the pixels extended in an $i^{th}$ (i is an integer) horizontal line includes an organic light emitting diode; a second transistor for controlling a capacity of an electric current that is supplied from a first power source to the organic light emitting diode; a first transistor coupled between a corresponding data line of the data lines and a gate electrode of the second transistor and for turning on when the scan signal is supplied to an $i^{th}$ scan line of the scan lines; a first capacitor coupled between the $i^{th}$ scan line and the gate electrode of the second transistor; a second capacitor coupled between the first power source and the gate electrode of the second transistor; and a feedback capacitor coupled between the gate electrode of the second transistor and an anode electrode of the organic light emitting diode.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
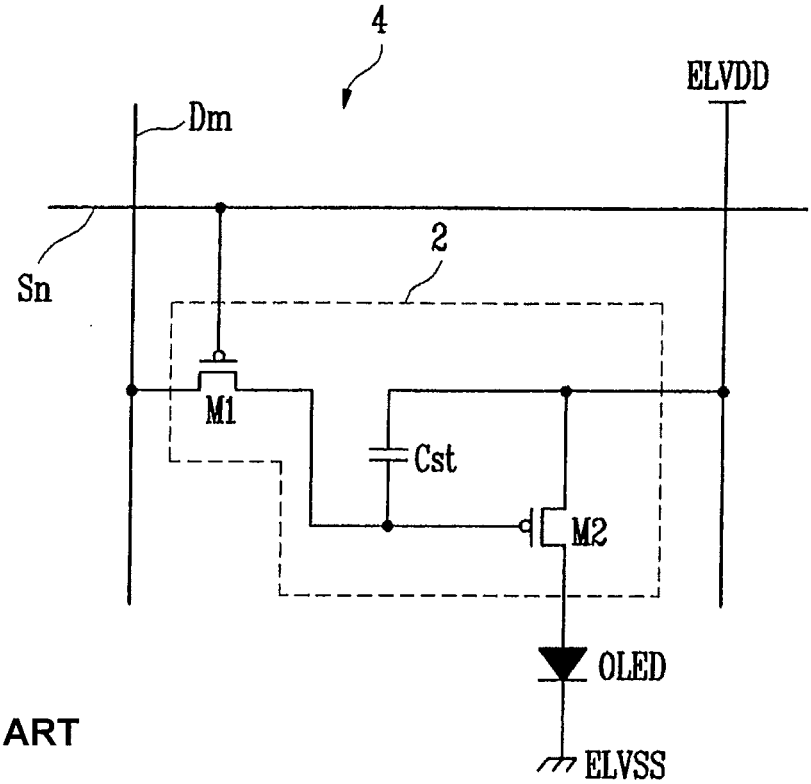
FIG. 1 is a circuit diagram schematically showing a pixel of a conventional organic light emitting display.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Figure 2:
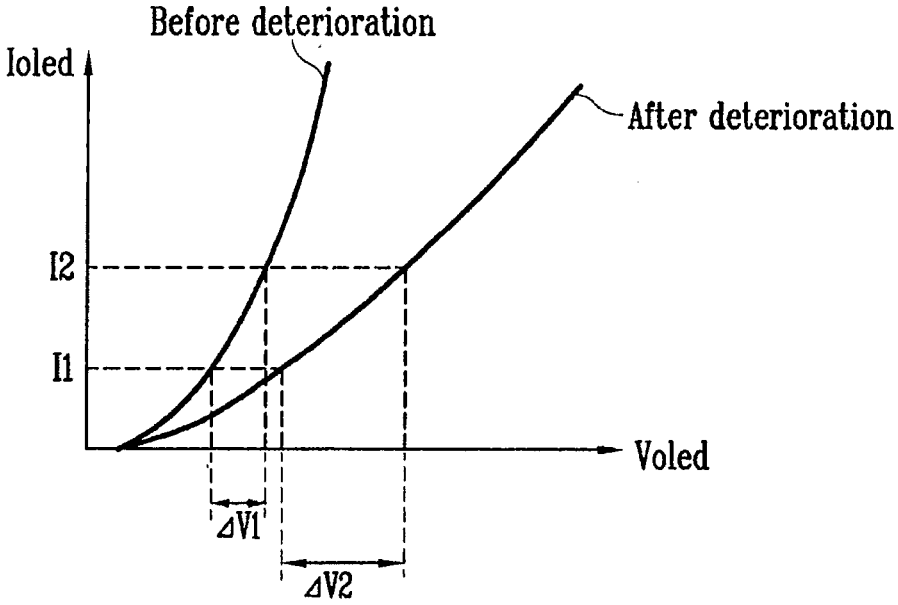
RELATED ART FIG. 2
FIG. 2 is a graph illustrating the deterioration characteristics of an organic light emitting diode.

FIG. 2 is a graph illustrating the deterioration characteristics of an organic light emitting diode. In FIG. 2, "Ioled" represents an electric current that flows in an organic light emitting diode, and "Voled" represents a voltage applied to the organic light emitting diode.

Referring to FIG. 2, a higher voltage is applied to an organic light emitting diode that is more deteriorated (after deterioration) to correspond to the same electric current of an organic light emitting diode that is less deteriorated (before deterioration). And, a voltage range (or difference) of $\Delta V1$ corresponds to a certain electric current range (I1 to I2) before the organic light emitting diode is deteriorated. However, after the organic light emitting diode is deteriorated, a voltage range of $\Delta V2$ having a higher voltage range than the voltage range of $\Delta V1$ corresponds to the certain electric current range (I1 to I2). Also, resistance components of the organic light emitting diode are increased in number as the organic light emitting diode is further deteriorated.

Figure 3:
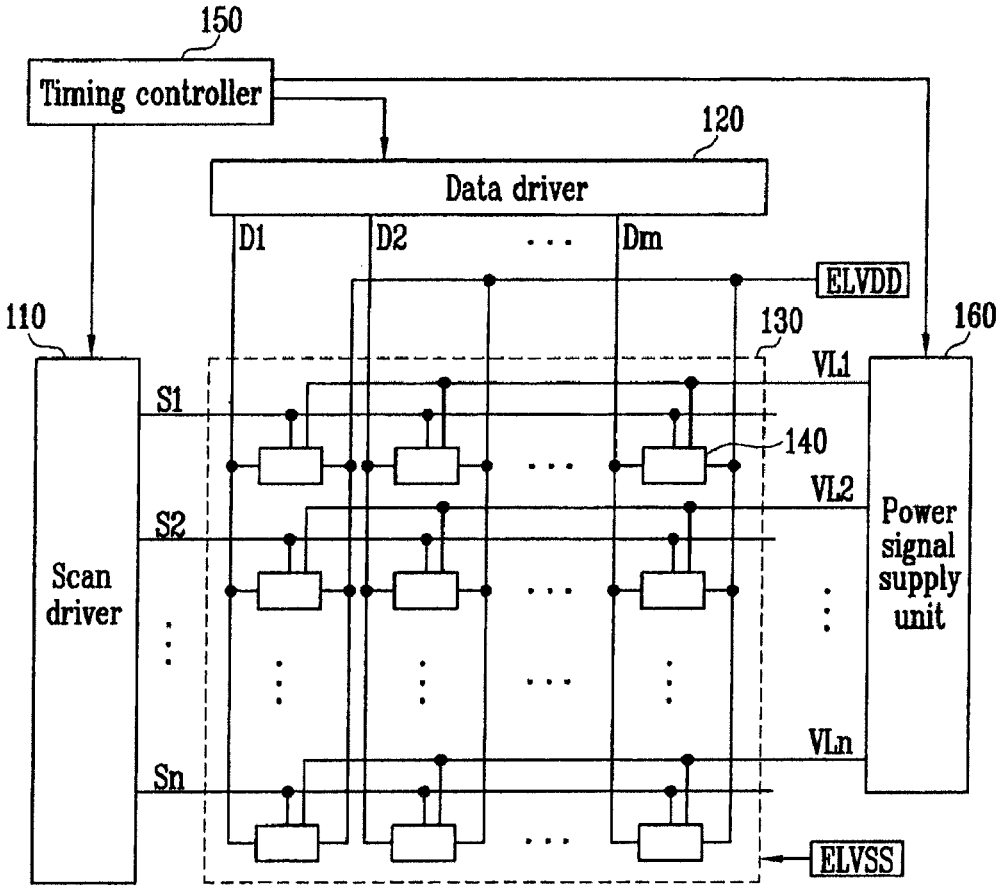
FIG. 3 is a diagram schematically showing an organic light emitting display according to one exemplary embodiment of the present invention.

FIG. 3 is a diagram schematically showing an organic light emitting display according to one exemplary embodiment of the present invention.

Referring to FIG. 3, the organic light emitting display includes a pixel unit (or display region) 130 including pixels 140 disposed at (or in) regions (or crossing regions) divided (or defined) by scan lines (S1 to Sn), power lines (VL1 to VLn) and data lines (D1 to Dm); a scan driver 110 to drive the scan lines (S1 to Sn); a data driver 120 to drive the data lines (D1 to Dm); a power signal supply unit 160 to drive the power lines (VL1 to VLn); and a timing controller 150 to control the scan driver 110, the data driver 120, and the power signal supply unit 160.

The scan driver 110 generates a scan signal under the control of the timing controller 150, and sequentially supplies the generated scan signal to the scan lines (S1 to Sn). Here, polarity of the scan signal is set to turn on a transistor in each of the pixels 140. For example, when the transistor in each of the pixels 140 is a P-channel metal-oxide semiconductor (PMOS), the polarity of the scan signal is set to a LOW voltage.

The power signal supply unit 160 sequentially supplies a power signal to the power lines (VL1 to VLn). Here, the power line (VL) receiving the power signal is set to a voltage of a third power source, and the power line (VL) that does not receive the power signal is set to a voltage of a fourth power source that is higher than that of the third power source. The power signal supplied to the $i^{th}$ power line (VLi) is overlapped with the scan signal supplied to the $i^{th}$ scan line (Si), and is also (concurrently or simultaneously) set to have a wider interval (or width) than that of the scan signal. Here, the power signal supply unit 160 may be deleted by a designer. In this case, a voltage of the scan line (S) that receives a scan signal is set to a voltage value of the third power source, and a voltage of the scan line (S) that does not receive a scan signal is set to a voltage value of the fourth power source.

The data driver 120 generates a data signal under the control of the timing controller 150, and supplies the generated data signal to the data lines (D1 to Dm) to synchronize with the scan signal.

The timing controller 150 controls the scan driver 110, the data driver 120, and the power signal supply unit 160. Also, the timing controller 150 transmits externally supplied data to the data driver 120.

The pixel unit 130 receives a power (or voltage) of a first power source (ELVDD) and a power (or voltage) of a second power source (ELVSS) from the outside of the pixel unit 130, and supplies the power of the first power source (ELVDD) and the power of the second power source (ELVSS) to each of the pixels 140. Each of the pixels 140 receiving the power of the first power source (ELVDD) and the power of the second power source (ELVSS) generates the light corresponding to the data signal.

The above-mentioned pixels 140 function to generate light with desired luminance by compensating for the deterioration of an organic light emitting diode that is included in each of the pixels 140. For this purpose, a compensation unit to compensate for the deterioration of an organic light emitting diode is installed in each of the pixels 140.

Figure 4:
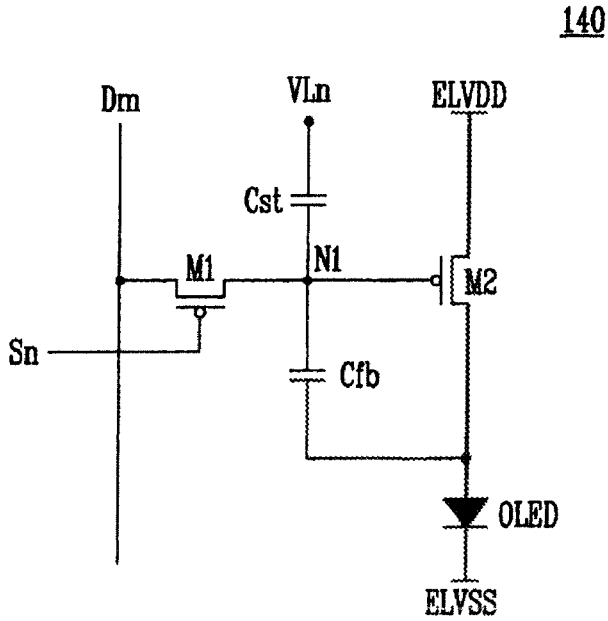
FIG. 4 is a circuit diagram schematically showing a pixel according to a first exemplary embodiment as shown in FIG. 3.

FIG. 4 is a circuit diagram schematically showing a pixel 140 according to a first exemplary embodiment as shown in FIG. 3. Here, a pixel coupled to an $n^{th}$ scan line (Sn) and an $m^{th}$ data line (Dm) is shown in FIG. 4 for convenience of the description.

Referring to FIG. 4, the pixel 140 according to the first exemplary embodiment of the present invention includes an organic light emitting diode (OLED); a second transistor (M2) to supply an electric current to the organic light emitting diode (OLED); a first transistor (M1) to supply a data signal to the second transistor (M2); a storage capacitor (Cst) to store a voltage corresponding to the data signal; and a feedback capacitor (Cfb) to control a voltage of first node (N1) to correspond to the change in a voltage of the organic light emitting diode (OLED).

An anode electrode of the organic light emitting diode (OLED) is coupled to a second electrode of the second transistor (M2), and a cathode electrode is coupled to the second power source (ELVSS). Such an organic light emitting diode (OLED) generates light with set (or predetermined) luminance to correspond to an electric current capacity supplied from the second transistor (M2). For this purpose, the first power source (ELVDD) has a higher voltage value than the second power source (ELVSS).

A gate electrode of the first transistor (M1) is coupled to the scan line (Sn), and a first electrode of the first transistor (M1) is coupled to the data line (Dm). A second electrode of the first transistor (M1) is coupled to a gate electrode (i.e., a first node (N1)) of the second transistor (M2). Such a first transistor (M1) is turned on when a scan signal is supplied to the scan line (Sn), thereby supplying a data signal, supplied from the data line (Dm), to the first node (N1).

A gate electrode of the second transistor (M2) is coupled to the first node (N1), and a first electrode of the second transistor (M2) is coupled to the first power source (ELVDD). A second electrode of the second transistor (M2) is coupled to an anode electrode of the organic light emitting diode (OLED). Such a second transistor (M2) supplies an electric current to the organic light emitting diode (OLED), the electric current corresponding to a voltage applied to the first node (N1).

The storage capacitor (Cst) is coupled between the first node (N1) and the power line (VLn). Such a storage capacitor (Cst) is charged with a voltage corresponding to the data signal.

The feedback capacitor (Cfb) is coupled between the first node (N1) and the anode electrode of the organic light emitting diode (OLED). Such a feedback capacitor (Cfb) controls a voltage of the first node (N1) to correspond to the changed voltage capacity of the organic light emitting diode (OLED).

Figure 5:
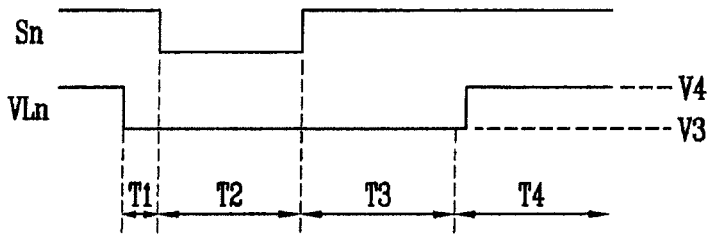
FIG. 5 is a waveform view showing a method for driving the pixel as shown in FIG. 4.

FIG. 5 is a waveform view showing a method for driving the pixel 140 as shown in FIG. 4.

The method for driving the pixel 140 will be described in more detail in combination with FIGS. 4 and 5. First, a power signal is supplied to a power line (VLn) during a first period (T1).

When the power signal is supplied to the power line (VLn), a voltage of the power line (VLn) drops from a voltage (V4) of the fourth power source to a voltage (V3) of the third power source. At this time, a voltage of the first node (N1) drops to correspond to the voltage drop of the power line (VLn) due to the coupling of the storage capacitor (Cst).

When the voltage of the first node (N1) drops, a first electric current is supplied from the second transistor (M2) to the organic light emitting diode (OLED). Here, the voltage (V3) of the third power source and the voltage (V4) of the fourth power source are set so that a high first electric current can flow from the second transistor (M2) to the organic light emitting diode (OLED). For example, the voltage (V3) of the third power source and the voltage (V4) of the fourth power source are set so that an electric current, which is higher than the maximum electric current that may flow in the organic light emitting diode (OLED), can flow to correspond to the data signal.

A voltage corresponding to the first electric current is applied to the organic light emitting diode (OLED) that receives the first electric current from the second transistor (M2). At this time, the feedback capacitor (Cfb) is charged with a voltage corresponding to the voltage difference between the voltage applied to the organic light emitting diode (OLED) and the voltage applied to the first node (N1).

During a second period (T2), a scan signal is supplied to the scan line (Sn). When the scan signal is supplied to the scan line (Sn), the first transistor (M1) is turned on. When the first transistor (M1) is turned on, a data signal supplied to the data line (Dm) is supplied to the first node (N1). At this time, the storage capacitor (Cst) is charged with a voltage corresponding to the data signal.

Meanwhile, the data signal is supplied to correspond to a higher grey level (i.e., to allow a more emission electric current to flow) than grey levels to be actually expressed so as to supply an electric current corresponding to the normal grey levels, when a voltage of the power line (VLn) increases afterwards.

The supply of a scan signal to the scan line (Sn) is suspended during a third period (T3). When the supply of the scan signal is suspended, the first transistor (M1) is turned off.

During this third period (T3), the feedback capacitor (Cfb) is continuously charged with a voltage that is applied to correspond to the first electric current supplied to the organic light emitting diode (OLED). Here, the first electric current refers to an electric current corresponding to the voltage drop of the data signal and power line (VLn).

The supply of a power signal supplied to the power line (VLn) is suspended during a fourth period (T4).

When the supply of the power signal to the power line (VLn) is suspended, a voltage of the power line (VLn) increases from the voltage (V3) of the third power source to the voltage (V4) of the fourth power source. At this time, a voltage of the first node (N1) also increases according to the voltage swell of the power line (VLn) because the first node (N1) is set to be in a floating state. In this case, the second transistor (M2) supplies a second electric current to the organic light emitting diode (OLED) to correspond to the voltage swell of the first node (N1), the second electric current being lower than the first electric current.

A voltage corresponding to the second electric current is applied to the organic light emitting diode (OLED) that receives the second electric current from the second transistor (M2). Here, a voltage applied to the organic light emitting diode (OLED) is set to a lower voltage value during the fourth period (T4), compared to the voltage as in the third period (T3) because the second electric current is an electric current that is lower than the first electric current.

At this time, the voltage of the first node (N1), which is set to be in the floating state, is changed according to the voltage applied to the organic light emitting diode (OLED). In fact, the voltage of the first node (N1) is changed as represented by the following Equation 1.

$$V_{N1} = V\text{data} - \{Cfb \times (Voled1 - Voled2)/(Cst + Cfb)\} \quad \text{Equation 1}$$

In the Equation 1, Voled1 represents a voltage that is applied to the organic light emitting diode (OLED) to correspond to the first electric current, Voled2 represents a voltage that is applied to the organic light emitting diode (OLED) to correspond to the second electric current, and Vdata represents a voltage corresponding to the data signal.

Referring to Equation 1, it is revealed that the voltage of the first node (N1) is changed when the voltage applied to the organic light emitting diode (OLED) is changed. Here, when the organic light emitting diode (OLED) is deteriorated, a voltage value of Voled1−Voled2 is increased due to the increased in the resistance of the organic light emitting diode (OLED), which leads to the increased voltage drop range of the first node (N1). That is, the capacity of an electric current that flows in the second transistor (M2) is increased to correspond to the same data signal when the organic light emitting diode (OLED) is deteriorated in the first exemplary embodiment of the present invention. Therefore, it is possible to compensate for the deterioration of the organic light emitting diode (OLED).

Figure 6:
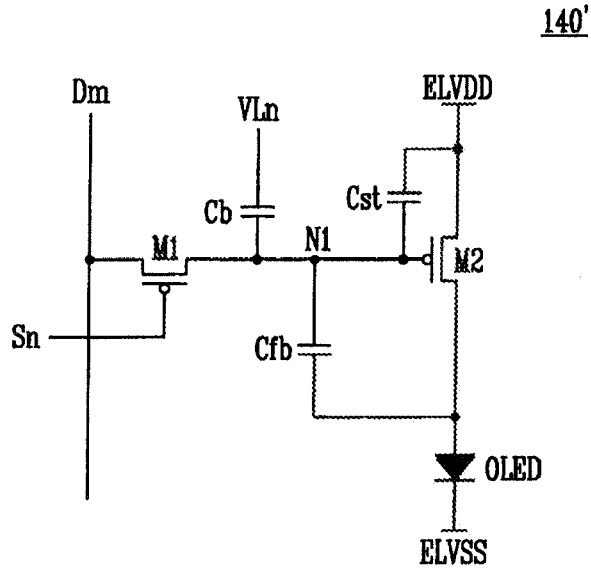
FIG. 6 is a circuit diagram schematically showing a pixel according to a second exemplary embodiment as shown in FIG. 3.

FIG. 6 is a circuit diagram schematically showing a pixel 140' according to a second exemplary embodiment of the present invention. The detailed description of the same components as in FIG. 4 is omitted for clarity purposes.

Referring to FIG. 6, the storage capacitor (Cst) is coupled between the first power source (ELVDD) and the first node (N1) for the pixel 140' according to the second exemplary embodiment of the present invention. Such a storage capacitor (Cst) is charged with a voltage corresponding to the data signal.

Also, a boosting capacitor (Cb) coupled between the power line (VLn) and the first node (N1) is further provided in the pixel 140' according to the second exemplary embodiment of the present invention. That is, the voltage of the first node (N1) is changed using the storage capacitor (Cst) in the case of the pixel 140 as shown in FIG. 4, but the voltage of the first node (N1) is changed using a separate boosting capacitor (Cb) in the case of the pixel 140' as shown in FIG. 6. The other procedures of the method according to the present invention are identical (or substantially identical) to that of the pixel 140 as shown in FIG. 4, and therefore the detailed description of the other procedures is omitted for clarity purposes.

Figure 7:
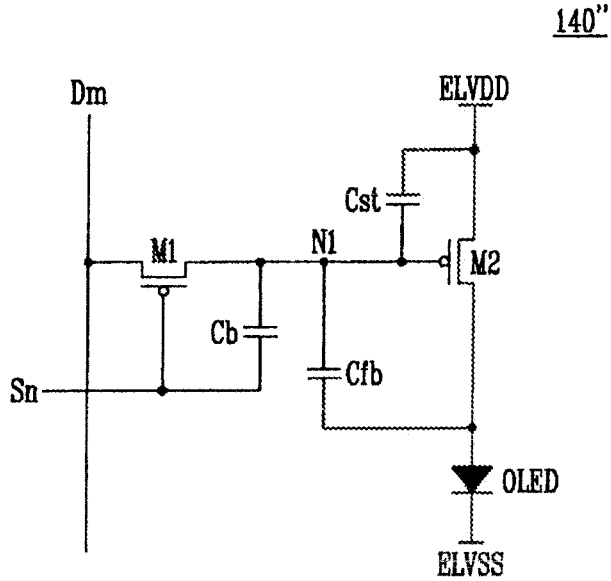
FIG. 7 is a circuit diagram schematically showing a pixel according to a third exemplary embodiment as shown in FIG. 3.

FIG. 7 is a circuit diagram schematically showing a pixel 140" according to a third exemplary embodiment of the present invention. The detailed description of the same components as in FIG. 6 is omitted for clarity purposes.

Referring to FIG. 7, for the pixel 140" according to the third exemplary embodiment of the present invention, a boosting capacitor (Cb) is coupled between the scan line (Sn) and the first node (N1). Such a boosting capacitor (Cb) changes a voltage of the first node (N1) to correspond to the scan signal supplied to the scan line (Sn).

Figure 8:
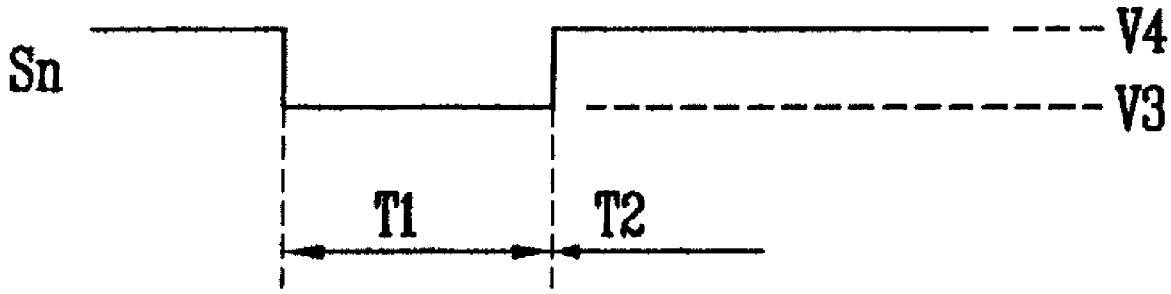
FIG. 8 is a waveform view showing a method for driving the pixel as shown in FIG. 7.

FIG. 8 is a waveform view showing a method for driving the pixel 140" as shown in FIG. 7.

The method for driving the pixel 140" will be described in more detail in combination with FIGS. 7 and 8. First, a scan signal is supplied to the scan line (Sn) during a first period (T1).

When the scan signal is supplied to the scan line (Sn), the first transistor (M1) is turned on. When the first transistor (M1) is turned on, a data signal is supplied to the first node (N1). When the scan signal is supplied to the scan line (Sn), a voltage of the scan line (Sn) drops from the voltage (V4) of the fourth power source to the voltage (V3) of the third power source. At this time, a voltage of the first node (N1) also drops by utilizing the boosting capacitor (Cb) to correspond to the voltage drop of the scan line (Sn).

When the voltage of the first node (N1) drops, a first electric current is supplied from the second transistor (M2) to the organic light emitting diode (OLED). Here, the first electric current refers to an electric current corresponding to the voltage drop of the data signal and scan line (Sn).

A voltage corresponding to the first electric current is applied to the organic light emitting diode (OLED) during the first period (T1). At this time, a voltage corresponding to the voltage difference between the voltage applied to the organic light emitting diode (OLED) and the voltage applied to the first node (N1) is charged in the feedback capacitor (Cfb).

The supply of the scan signal to the scan line (Sn) is suspended during a second period (T2). When the supply of the scan signal to the scan line (Sn) is suspended, the first transistor (M1) is turned off. When the supply of the scan signal to the scan line (Sn) is suspended, a voltage of the scan line (Sn) increases from the voltage (V3) of the third power source to the voltage (V4) of the fourth power source. At this time, the voltage of the first node (N1) also increases to correspond to the voltage swell of the scan line (Sn) because the first node (N1) is set to be in a floating state. In this case, the second transistor (M2) supplies a second electric current to the organic light emitting diode (OLED) to correspond to the voltage of the first node (N1), the second electric current being lower than the first electric current.

A voltage corresponding to the second electric current is applied to the organic light emitting diode (OLED) that receives the second electric current from the second transistor (M2). Here, a voltage applied to the organic light emitting diode (OLED) during the second period (T2) is set to a lower voltage value than the voltage as in the first period (T1) because the second electric current is an electric current that is lower than the first electric current.

At this time, the voltage of the first node (N1), which is set to be in the floating state, is changed according to the voltage applied to the organic light emitting diode (OLED). That is, the voltage applied to the first node (N1) is changed according to the voltage applied to the organic light emitting diode (OLED). Here, when the organic light emitting diode is deteriorated, the difference in the voltage applied to the organic light emitting diode (OLED) is increased to correspond to the first electric current and the second electric current, which leads to the increased voltage drop range of the first node (N1). That is, an electric current that flows form the second transistor (M2) is increased to correspond to the same data signal when the organic light emitting diode (OLED) is deteriorated in the third exemplary embodiment of the present invention. Therefore, it is possible to compensate for the deterioration of the organic light emitting diode (OLED).

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode;

a second transistor for controlling a capacity of an electric current that is supplied from a first power source to the organic light emitting diode;

a first transistor coupled between a data line and a gate electrode of the second transistor and for turning on when a scan signal is supplied to a scan line;

a first capacitor coupled between a power line for receiving a power signal and the gate electrode of the second transistor, the power signal overlapping with the scan signal and having a wider interval than that of the scan signal; and a feedback capacitor coupled between the gate electrode of the second transistor and an anode electrode of the organic light emitting diode.

2. The pixel according to claim 1, further comprising a second capacitor coupled between the first power source and the gate electrode of the second transistor.

3. A pixel comprising:

an organic light emitting diode;

a second transistor for controlling a capacity of an electric current supplied from a first power source to the organic light emitting diode;

a first transistor coupled between a data line and a gate electrode of the second transistor and for turning on when a scan signal is supplied to a scan line;

a first capacitor coupled between the scan line and the gate electrode of the second transistor;

a second capacitor coupled between the first power source and the gate electrode of the second transistor; and a feedback capacitor coupled between the gate electrode of the second transistor and an anode electrode of the organic light emitting diode.

4. An organic light emitting display comprising:

a scan driver for sequentially supplying a scan signal to scan lines;

a power signal supply unit for sequentially supplying a power signal to power lines;

a data driver for supplying a data signal to data lines to synchronize with the scan signal; and pixels at crossing regions of the scan lines, the data lines and the power lines, wherein each of the pixels extended in an $i^{th}$ horizontal line of the organic light emitting display comprises:

an organic light emitting diode;

a second transistor for controlling a capacity of an electric current that is supplied from a first power source to the organic light emitting diode;

a first transistor coupled between a corresponding data line of the data lines and a gate electrode of the second transistor and for turning on when the scan signal is supplied to an $i^{th}$ scan line of the scan lines;

a first capacitor coupled between an $i^{th}$ power line of the power lines and the gate electrode of the second transistor; and a feedback capacitor coupled between the gate electrode of the second transistor and an anode electrode of the organic light emitting diode, and wherein i is an integer.

5. The organic light emitting display according to claim 4, wherein a voltage of a third power source is supplied to the $i^{th}$ power line when the power signal is supplied to the $i^{th}$ power line, and a voltage of a fourth power source that is higher than that of the third power source is supplied to the $i^{th}$ power line when the power signal is not supplied to the $i^{th}$ power line.

6. The organic light emitting display according to claim 5, wherein the voltages of the third power source and the fourth power source are set to a voltage value so that an electric current flows in the second transistor, the electric current being higher than an electric current that flows to correspond to the data signal.

7. The organic light emitting display according to claim 4, wherein the power signal supply unit is adapted to supply the power signal to overlap with the scan signal supplied to the $i^{th}$ scan line, and to supply the power signal to the $i^{th}$ power line, the power signal having a wider interval than that of the scan signal.

8. The organic light emitting display according to claim 4, wherein the data signal is set to a voltage corresponding to a higher grey level than grey levels to be actually expressed.

9. The organic light emitting display according to claim 4, further comprising a second capacitor coupled between the first power source and the gate electrode of the second transistor.

10. An organic light emitting display, comprising:

a scan driver for sequentially supplying a scan signal to scan lines;

a data driver for supplying a data signal to data lines to synchronize with the scan signal; and pixels disposed at crossing regions of the scan lines and the data lines, wherein each of the pixels extended in an $i^{th}$ horizontal line comprises:

an organic light emitting diode;

a second transistor for controlling a capacity of an electric current that is supplied from a first power source to the organic light emitting diode;

a first transistor coupled between a corresponding data line of the data lines and a gate electrode of the second transistor and for turning on when the scan signal is supplied to an $i^{th}$ scan line of the scan lines;

a first capacitor coupled between the $i^{th}$ scan line and the gate electrode of the second transistor;

a second capacitor coupled between the first power source and the gate electrode of the second transistor; and a feedback capacitor coupled between the gate electrode of the second transistor and an anode electrode of the organic light emitting diode, and wherein i is an integer.

11. The organic light emitting display according to claim 10, wherein a voltage of a third power source is supplied to the $i^{th}$ scan line when the scan signal is supplied to the $i^{th}$ scan line, and a voltage of a fourth power source that is higher than that of the third power source is supplied to the $i^{th}$ scan line when the scan signal is not supplied to the $i^{th}$ scan line.

12. The organic light emitting display according to claim 11, wherein the voltages of the third power source and the fourth power source are set to a voltage value so that an electric current flows in the second transistor, the electric current being higher than an electric current that flows to correspond to the data signal.

13. The organic light emitting display according to claim 10, wherein the data signal is set to a voltage corresponding to a higher grey level than grey levels to be actually expressed.

* * * * *